US010378776B2

(12) United States Patent
Luk

(10) Patent No.: US 10,378,776 B2
(45) Date of Patent: Aug. 13, 2019

(54) STOVE SHIELD

(71) Applicant: John Luk, Astoria, NY (US)

(72) Inventor: John Luk, Astoria, NY (US)

( * ) Notice: Subject to any disclaimer, the term of this patent is extended or adjusted under 35 U.S.C. 154(b) by 360 days.

(21) Appl. No.: 15/330,082

(22) Filed: Aug. 3, 2016

(65) Prior Publication Data

US 2018/0038599 A1 Feb. 8, 2018

(51) Int. Cl.
*F24C 15/12* (2006.01)

(52) U.S. Cl.
CPC ..... *F24C 15/12* (2013.01)

(58) Field of Classification Search
CPC ..... F24C 15/12
USPC ..... 126/214 D
See application file for complete search history.

(56) References Cited

U.S. PATENT DOCUMENTS 1,970,054 A * 8/1934 Nordan ..... F24C 15/12 126/201
2,568,276 A * 9/1951 Eggleston ..... F24C 15/36 126/1 R
2,582,373 A 1/1952 Cordrey
2,591,786 A 4/1952 Cronheim
4,150,664 A 4/1979 Trombatore
D303,909 S 10/1989 Stankus
5,546,928 A 8/1996 Lewis
6,079,163 A * 6/2000 Daoud ..... H02G 3/088 52/66
6,371,105 B1 4/2002 Merritt
6,866,035 B2 3/2005 Haemerle
8,151,785 B2 4/2012 Dang
8,833,361 B2 9/2014 O'Keefe

OTHER PUBLICATIONS

Lowes, Broan 24-in×30-in Stainless Steel Metal Kitchen Backsplash, http://www.lowes.com:80/pd/Broan-24-in-x-30-in-Stainless-Steel-Metal-Kitchen-Backsplash/1092009.*
Lowes, Broan 24-in×30-in Stainless Steel Metal Kitchen Backsplash, http://www.lowes.corn:80/pd/Broan-24-in-x-30-in-Stainless-Steel-Metal-Kitchen-Backsplash/1092009 (Year: 2016).*

* cited by examiner

*Primary Examiner* — Steven B McAllister
*Assistant Examiner* — Allen R Schult
(74) *Attorney, Agent, or Firm* — Randal Homburg

(57) ABSTRACT

A shield for protection of the back splash and wall behind a stove, providing an expandable shield suspended behind the stove while the stove is in use, the shield expanded into a deployed position and attached to the wall and secured within an upper shelf upon a support, the shield further stored behind the stove in a contracted position upon a lower shelf of the support, with the support mounted to either the wall behind the stove or upon the stove itself on a rear potion of the stove. The shield may also be used upon the back splash of a sink or other cooking station where protection of the back splash is desired.

2 Claims, 3 Drawing Sheets

STOVE SHIELD

CROSS REFERENCE TO RELATED APPLICATIONS

BACKGROUND OF THE INVENTION

1. Field of Invention

A shield for protection of the back splash and wall behind a stove, providing an expandable shield suspended behind the stove while the stove is in use, the shield expanded into a deployed position and attached to the wall and secured within an upper shelf upon a support, the shield further stored behind the stove in a contracted position upon a lower shelf of the support, with the support mounted to either the wall behind the stove or upon the stove itself on a rear potion of the stove. The shield may also be used upon the back splash of a sink or other cooking station where protection of the back splash is desired.

2. Description of Prior Art

A preliminary review of prior art patents was conducted by the applicant which reveal prior art patents in a similar field or having similar use. However, the prior art inventions do not disclose the same or similar elements as the present stove guard, nor do they present the material components in a manner contemplated or anticipated in the prior art.

Free standing spatter guards are demonstrated in several prior art United States patents. In U.S. Pat. No. D303,909 to Stankus, a standing guard is shown forming a hinged panel vertical guard with two folding rear extensions to provide a shield behind the burners of a stove with the guard being suited for placement on the stove surface. This is further shown in U.S. Pat. No. 6,866,035 to Haemerle and U.S. Pat. No. 2,591,786 to Cronheim and U.S. Pat. No. 2,582,373 to Cordrey. Other spatter shields are shown which attach to the stove at some location and either elevate or extend from a non-use position to an in-use position. These prior art patents include U.S. Pat. No. 4,150,664 to Trombatore, which provide laterally anchored elevating panels for side spatter protection, U.S. Pat. No. 8,151,785 to Dang and U.S. Pat. No. 5,546,928 to Lewis, providing front mounted panel extensions to prevent small children from reaching hot pans, skillets and other items on the stove surface (but can serve to deflect grease and water spatter during stove top cooking), U.S. Pat. No. 6,371,105 to Merrit, providing several hinged panels on a stove top to selectively cover each non-use burning during use of another burner, and U.S. Pat. No. 8,833,361 to O'Keefe, which provides a collapsible shield providing at least a first proximal and a second distal panel configured to move vertically and pivotally with each other. These panels are aligned and connected on a horizontal plane when collapsed and stacked vertically when elevated and locked into a position during use using a piano hinge system wherein the user lifts and pulls forward the connected panels to form the vertical barrier.

The present stove shield provides a first and second panel which slidably engage at the lateral margins with the first or top panel attached to the wall behind the stove while the second or lower panel rests within an upper shelf of a panel support during extension and use, with the first and second panels sliding to a compact profile for storage within a lower shelf of the panel support, the panel support attaching to a wall behind the stove or the back portion of the stove itself. The panel may also be used behind a sink or other work station.

SUMMARY OF THE INVENTION

Stove top cooking, while providing meal after meal, comes with the burden of cleaning up after one is done finishing a meal. Inevitably, if one is frying, boiling or using the stove top burners in any manner, there is the potential of spatter. Grease, water and other food substances often escape the confines of the cookware and end up on the stove itself as well as the back splash or wall behind the stove. Many back splash panels are tile, painted wall board, stainless steel or other materials often treated for cleanup after each use of the stove. As easy as these back splashes may be to clean, it would be preferable not to have to clean these vertical surface and reach over the stove to conduct the cleaning process.

As seen in prior art, there are several products which provide a shield or barrier to the various margins of the stove, all having particularly described features that provide a diversity of elements that provide a preferable means to avoid stove spattering. The present device provides an expandable barrier which can be deployed for use in an expanded presentation and store behind the stove in a compact position to be used as needed. The present device further provides a removable shield which can be cleaned in the sink and stored in a location behind the stove for convenient access to the cook. It provides a wall mounting means for deployment and a wall storage and storage for the expandable barrier in a compact position by the provision of at least two shelves included within the wall mounting means. The wall mounting means may be placed on the wall behind the stove or on the back of the stove itself on free standing stoves or ranges. It may also be used at other locations where spatter may occur, including behind a sink or counter work surface area.

DESCRIPTION OF THE DRAWINGS

The following drawings are submitted with this utility patent application.

DESCRIPTION OF THE PREFERRED EMBODIMENT

Figure 1:
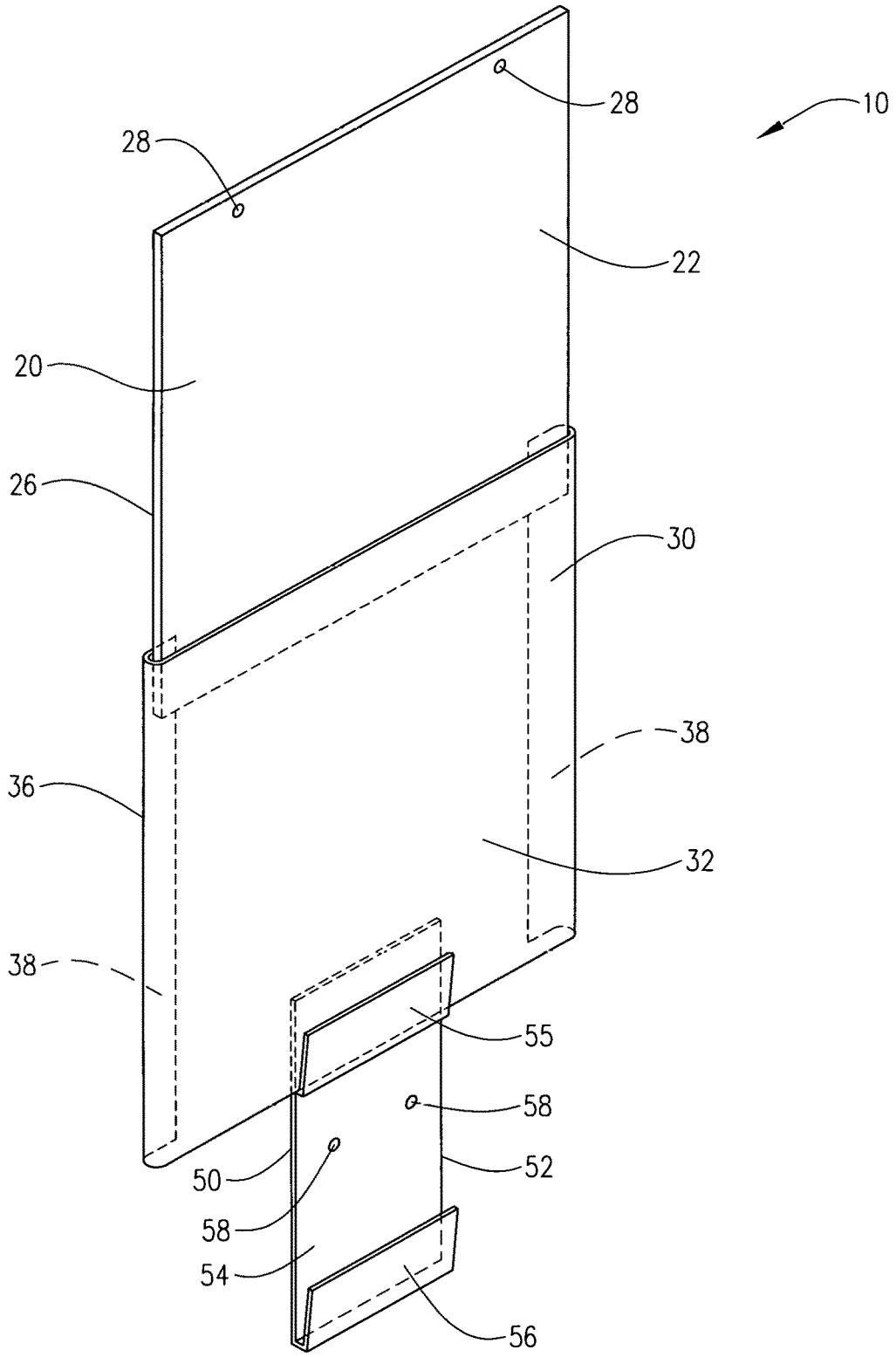
FIG. 1 is a front perspective view of the spatter shield in an expanded position and placed within the upper shelf as would be placed during use.
Figure 2:
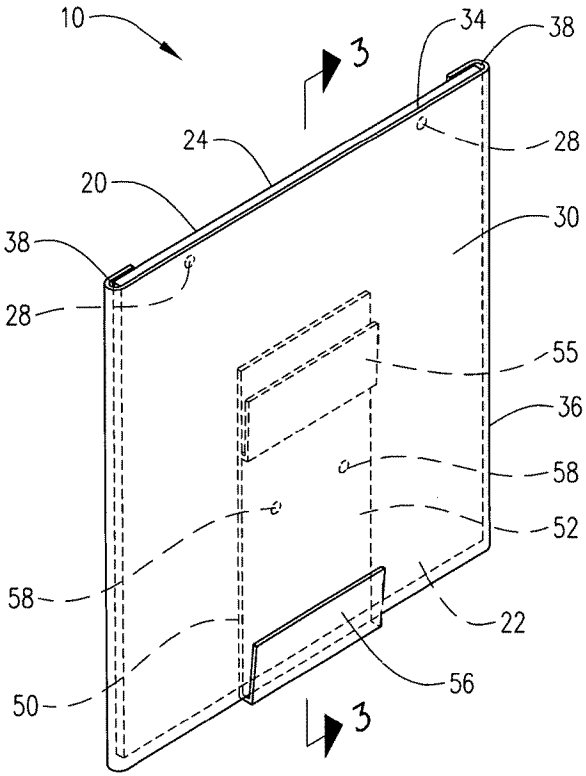
FIG. 2 is a front perspective view of the spatter shield in a collapsed position and placed within the lower shelf as could be placed during storage.
Figure 4:
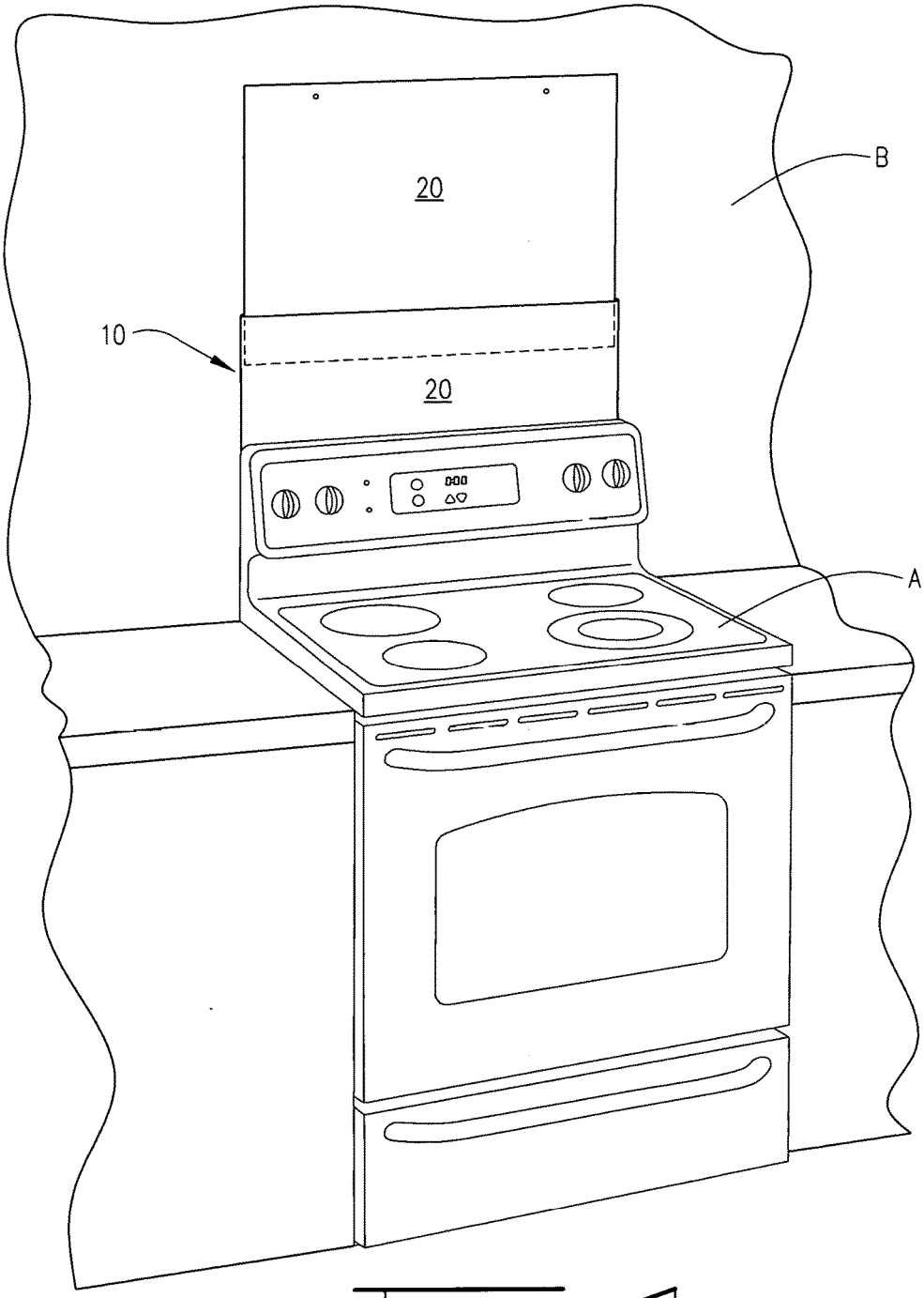
FIG. 4 is a front perspective view of the spatter shield during use behind a stove.

An expandable spatter shield 10 for use in the kitchen or other location where cooking and cleaning may occur to prevent spatter from water or grease, as shown in FIGS. 1-4 of the drawings, comprises an upper plate 20 having a front surface 22 and rear surface 24 and a lower plate 30 having a front surface 32 and rear surface 34, the upper and lower plates 20, 30 slidably engaging one another along each plates lateral edges 26, 36 forming an expanded position, FIG. 1, and a collapsed position, FIG. 2. Preferably the lateral edges 36 of the lower plate 30 are bent to form a lateral channel 38 and the lateral edges 26 of the upper plate 20 slide within the lateral channel 38 of the lower plate 30, FIG. 1. The lateral channel may also be formed in the lateral edges 26 of the upper plate 20, with the lateral edges 36 of the lower plate 30 sliding within lateral channel of the upper plate 20, not shown. Within the upper plate 20 is at least one upper mounting member 28, FIG. 1, which may be embodied as a hole, a hook on the rear surface, a formed indentation or other securing mechanism which would provide a location for a vertical plate support means attached to a wall B or vertical surface to maintain the upper plate 20 at an elevation.

Figure 3:
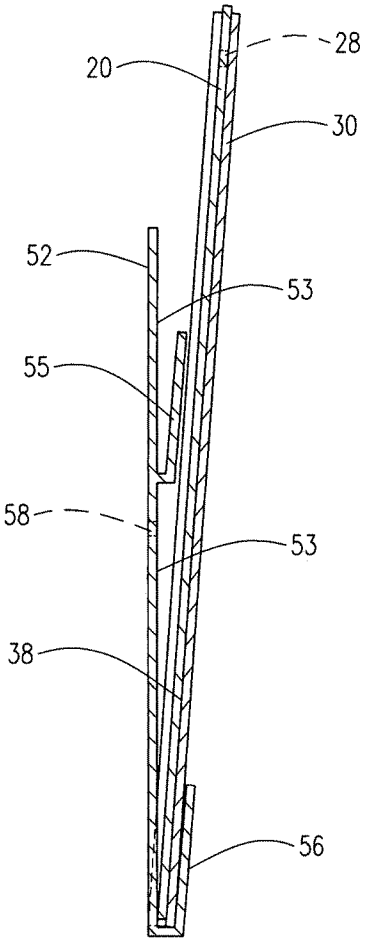
FIG. 3 is a sectional view of the spatter shield and mounting bracket along lines 3/3 of FIG. 2.

In conjunction with the expandable spatter shield 10, a mounting bracket 50 is provided for the support and storage of the expandable spatter shield 10 to a wall B during use or storage, FIGS. 1-3. The mounting bracket 50 defines a backplate 52 with a front surface 53 and a rear surface 54, an upper shelf 55 extending away and upwards from the front surface 53 of the backplate 52 and a lower shelf 56 extending away and upwards from the front surface 53 of the backplate 52, FIGS. 1 and 3, below the upper shelf 55. In one use, depending upon the application of the spatter shield 10, the rear surface 54 of the mounting bracket 50 is attached to the wall B behind a stove A below the level of the highest elevation of the stove A, FIG. 4. In another use, the rear surface 52 of the mounting bracket 50 is attached to a rear surface of the stove A itself, not shown. This is accomplished by providing the mounting bracket 50 with at least one vertical surface mounting member 58, which may be embodied within the backplate 52 as a hole, a hook on the rear surface 54, a formed indentation or other securing mechanism which would provide a location for a vertical bracket support means attached to the wall B or the rear surface of the stove A to maintain the mounting bracket 50 attached to the intended surface or wall B. This mounting bracket 50 may also be incorporated directly in the back of the stove A as an OEM component having the same upper shelf 55 and lower shelf 56.

The vertical plate and vertical bracket support means may include a nail, a peg, a magnet where the vertical surface is metal, a hook, or removable and reusable adhesive, not shown. The bracket support means would be permanently mounted, while the plate support means would need to allow for placement and removal of the spatter shield 10 for storage or cleaning.

It is also contemplated that the spatter shield A may be set behind a sink during times when a user may choose to prevent spatter during cleanup of dishes, pots and pans, especially those that are heavily soiled or during times when the sink is used as a wash basin for vegetable washing, cleanup using corrosive materials for removal of scale or lime, and also during meat, fish or chicken preparation prior to cooking. It is preferred that the spatter shield 10 is made from a material that is smooth without an porousness, and that it be made of a durable material that resists heat, grease, water and solid materials, without spotting, that is easily cleaned for reuse. In this regard, materials including aluminum, stainless steel, plastic or polymer, and coated metals be used for the purpose of hygiene and ease of manufacturing to maintain a low cost to the consumer. It should resist rust or corrosion and be subject to multiple repeated use. Likewise, the mounting bracket 50 would be made of the same or similar choice of material.

Still contemplated by using the same spatter shield 10, includes another mounting apparatus mounting the spatter shield 10 to a wall or stove at a selected extension height, including but not limited to a bracket having parallel vertical side slide channels which may include a plurality of extrusions which would receive a resilient locking means in the lateral edges 36 of the lower plate 30 selectively engaging one of the plurality of extrusions to lock the elevated lower plate 30 at a selected height and then optionally further extend the upper plate 20 from within the lower plate to an additional vertical height. As this would likely constitute a separate species requiring an election, the inventor herein reserves the right to disclose and claim this subject matter in an additional patent upon separate filing pursuant to the rules and statutes pertaining to such subsequent filings.

While the spatter shield 10 and mounting bracket 50 have been particularly shown and described with reference to a preferred embodiment thereof, it will be understood by those skilled in the art that changes in form and detail may be made therein without departing from the spirit and scope of the invention.

What is claimed is:

1. An expandible spatter shield for use in the kitchen or other location where cooking and cleaning may occur to prevent spatter from water or grease comprising:

an upper plate having a front surface and rear surface and a lower plate having a front surface and rear surface, said upper and lower plates slidably engaging one another along respective lateral edges of each said plate forming an expanded position and a collapsed position, with said lateral edges of said lower plate bent to form a lateral channel and said lateral edges of said upper plate sliding within said lateral channel of said lower plate;

at least one upper mounting member providing a location for a vertical plate support means attached to a wall or vertical surface to maintain said expanded upper plate at a vertical elevation;

a mounting bracket providing support and storage of said expandible spatter shield to said wall during use or storage; and said mounting bracket further comprising:

a backplate with a front surface and rear surface, an upper shelf extending away and upwards from said front surface of said backplate and a lower shelf extending away and upwards from the front surface of said backplate below said upper shelf, said rear surface of said backplate attached to said wall behind said stove or attached directly to a rear of said stove between said wall and said stove through said backplate by at least one vertical surface mounting member.

2. An expandible spatter shield for use in the kitchen or other location where cooking and cleaning may occur to prevent spatter from water or grease comprising:

an upper plate having a front surface and rear surface and a lower plate having a front surface and rear surface, said upper and lower plates slidably engaging one another along respective lateral edges of each said plate forming an expanded position and a collapsed position, with said lateral edges of said lower plate bent to form a lateral channel and said lateral edges of said upper plate sliding within said lateral channel of said lower plate;

at least one upper mounting member providing a location for a vertical plate support means attached to a wall or vertical surface to maintain said expanded upper plate at a vertical elevation;

a mounting bracket providing support and storage of said expandible spatter shield to said wall during use or storage; and said mounting bracket further comprising:

a backplate with a front surface and rear surface, an upper shelf extending away and upwards from said front surface of said backplate and a lower shelf extending away and upwards from the front surface of said backplate below said upper shelf, said mounting bracket incorporated directly into a back of said stove as an OEM component.

* * * * *